United States Patent [19]

Koch

[11] Patent Number: 4,662,487

[45] Date of Patent: May 5, 1987

[54] STRETCHABLE BELT AND PROCESS FOR THE PRODUCTION THEREOF

[75] Inventor: Gerhard Koch, Ophain, Belgium

[73] Assignee: Ieperband N.V., Belgium

[21] Appl. No.: 738,020

[22] Filed: May 24, 1985

[30] Foreign Application Priority Data

Jun. 7, 1984 [DE] Fed. Rep. of Germany ..... 3421146

[51] Int. Cl.[4] ..... A62B 35/00

[52] U.S. Cl. ..... 188/371; 280/805; 297/472

[58] Field of Search ..... 188/371, 268; 280/805; 297/470, 471, 472; 87/324, 28; 28/166

[56] References Cited

U.S. PATENT DOCUMENTS 3,820,843 6/1974 Seo et al. ..... 297/472

4,126,356 11/1978 Takada ..... 297/472

*Primary Examiner*—Duane A. Reger

*Assistant Examiner*—Matthew C. Graham

*Attorney, Agent, or Firm*—Paul & Paul

[57] ABSTRACT

A stretchable belt, such as for safety belt restraint systems in vehicles, includes a base material and at least one additional material having a different stress-stretch curve. By providing a base material with higher deformability than the additional material the stress-stretch curve of the belt has a first steeply rising portion where the load is primarily transmitted to the additional material. At a given load point, the additional material abruptly tears, and the load is transmitted to the base material. Thereafter, the stress versus stretch curve continues at a substantially lower angle. In this manner, the belt absorbs a maximum amount of energy for a given maximum load and maximum stretch. The belt may be formed from a single type of raw material, mechanically or thermally treating it to provide different stress versus stretch characteristics for the base material and the additional material.

11 Claims, 4 Drawing Figures

STRETCHABLE BELT AND PROCESS FOR THE PRODUCTION THEREOF

The invention relates to a stretchable belt, in particular a safety belt for restraint systems in vehicles, comprising a base material and at least one additional material which is combined therewith.

The invention will be described hereinafter by reference to a safety belt in vehicles, although it will be appreciated that the invention is not restricted to that situation of use.

A stretchable belt is known, in motor vehicles, for restraining an occupant at the moment of an accident. At such a time, as much energy as possible must be nullified. For that purpose, use is made of energy-absorbing belts which stretch when subjected to load. In other words, the body of the occupant of the vehicle applies a load or a pressure to the belt and the belt can stretch by a given amount, absorbing energy as it does so. The distance by which the belt stretches, that is to say, the stretching action of the belt, should be utilised to the maximum but should not be exceeded. In other words, in a safety system in a motor vehicle, for the optimum absorption of energy, the degree of stretch should be as great as possible in order to permit the absorption of energy by means of the motion which is thereby additionally made available. However, the distance by which the belt stretches may be only of such a magnitude that the occupant of the vehicle does not come into contact with objects which are in front of him, such as for example the windscreen, the instrument panel or the like. On the other hand, the stretchability may not be so slight that, at the moment of an accident, the body of the occupant would for example be subjected to an excessive load and would suffer injury as a result.

In the case of fabrics or belts which are commercially available at the present time, the belt may be given a mode of performance such that it stretches when a force is applied thereto, by virtue of using certain base materials. On the one hand, the belt or fabric may be of a given construction (kind of weave, laminate structure) whereby a particular form of stretch performance may be incorporated therein, just as by virtue of thermal treatment of the finished belt. Although it is possible in that way to produce fabrics or belts which have high, medium or low stretch, it is however not possible to achieve a given curve configuration wherein the increase in force in relation to stretch is given as a percentage, because without limit conditions, it is not possible to preset particular points of a specific reference stretch value.

In addition, shock damping or absorption by the absorption of energy by a belt has already been provided, by the respective belt being laid in a loop and the loop being fixed by means of tear-type seams. That arrangement also involves a particular construction of the finished belt, by means of which the belt is made thicker at the location of the loop.

Lines of thought have also already been followed, regarding using a specific woven construction in order to influence the stretch capability of a belt to be formed. However, there is the disadvantage that those constructions always become too bulky with the result of belts of excessive thickness.

The same disadvantage is also to be found in other known constructions wherein polyamide or rayon are used as the cores, and are then made up into a woven structure by means of a suitable connecting construction.

If, in the course of producing a belt, use is made of threads with the same characteristic, the stretch capability can therefore only be achieved by providing a correspondingly thick construction. If threads of different characteristics or properties are used, and if a special construction is additionally provided for the purposes of absorbing energy, then although the stress-stretch curves can be made flatter, the end product, that is to say, the belt or fabric, is always still of an undesirably large thickness.

The object of the present invention is therefore to provide a stretchable belt and a process for the production thereof, wherein a desired ideal stress-stretch curve for a given absorption of energy is achieved and the belt, while being of the same thickness as the conventional standard belts, nonetheless has a high level of strength.

According to the invention, in regard to the belt, that object is attained in that the base material is more highly deformable, with the same force, than at least one additional material. A high degree of deformability means a high degree of stretchability. In other words, such a belt has a high degree of stretch and therefore absorbs energy by increasing the length of the distance covered by an occupant of a vehicle forwardly in the direction of movement at the moment of an accident. In accordance with the invention therefore, there are two materials which have a different stress-stretch curve. In that connection, the material having the highest degree of stretchability is used as the base material. The additional material has a lower stretch capability in comparison with the base material so that it (abruptly) tears, at a given load point. In the belt, the additional material may form for example the stem or stalk portions.

If a stretchable belt is produced from the above-described materials and if the belt is subjected to a loading, then the stress-stretch curve may be described in two initial phases. In the first phase, for example at the moment of an accident, the body of the occupant is pressed against the belt and in so doing stretches primarily the stem portions or the additional material (loaded in the longitudinal direction of the belt), which gives a steeper rise to the curve and which tears at a given value in respect of the applied force. Because of that, the body of the occupant covers only a very small distance in the initial range. At that first reference stretch value, the load applied to the belt by the occupant is transmitted to the base material having the higher degree of stretch capability. Thereafter, the curve continues at a substantially lower angle, more or less in a rectilinear configuration.

In accordance with the invention it is particularly advantageous for the base material and the additional material to comprise the same stuff. From the point of view of the production procedure, it may be desirable to use the same raw material for forming the belt according to the invention, and to provide the different stretch properties of the base material on the one hand and the additional material on the other hand by mechanical and/or thermal means. The stretch capability is also to be influenced by means of the construction, as was necessarily also always the case with conventional belts. When using threads or yarns which lie flat and smooth, the stretch (material stretch) which is inherent therein or which is caused by the nature of the material itself cannot be altered. On the other hand, the amount of stretch may be increased in the weaving operation for example by double binding or linking in the weave. In accordance with the invention however, the endeavour is made to keep the constructional stretch at a low level so that the belt does not become too thick.

In a given preferred embodiment, the invention provides that the base material and the additional material are combined by weaving to form an at least one-ply or single-layer fabric. In such a fabric, in accordance with the invention, the additional material may advantageously be the warp material with a low degree of stretchability with the material having the highest degree of stretchability being used as the carrier. As the warp threads are known to be disposed in the lengthwise direction of the belt, the initial absorption of force is firstly effected by means of such threads so as to give the steep beginning to the curve, in the above-described manner. Then, after tearing of the warp threads, the material with the highest degree of stretch capability, as the carrier material, takes over the further loading, namely in the part of the stress-stretch curve which rises at a lower angle, in phase II.

Although the ideal stress-stretch curve can be achieved by using many base materials and many additional materials, it has been found adequate and highly desirable if, in accordance with the invention, only two materials of different stretch capability are combined together. In that construction, the first material with the low degree of deformability or stretchability provides the phase I in the steep region of the rising curve while the other base material takes over the loading with a higher degree of stretchability, once the warp threads have torn, which threads can therefore also be referred to as tear threads or tear belts.

It has been found particularly advantageous if, in accordance with the invention, the additional material has no or almost no stretchability caused by the material used or the belt construction. In the stress-stretch curve, that means that, in phase I, the less deformable additional material produces no or almost no stretch and thus gives only a low degree of absorption of energy.

The novel belt according to the invention is of such a structure that its performance in regard to elongation at rupture can be influenced to give the optimum characteristics. With the values of the stress-stretch curve, the belt may be of such a nature that, under the loading on the belt, there is first a steep rise in the curve, which flattens out at a pre-programmed point at the end of phase I, the first reference stretch point, while in the flatter region (phase II), the carrier or base material then carries the loading and absorbs energy. By virtue of using materials of different deformability or stretchability, the thickness of the fabric or belt according to the invention may be retained or remain at a low value, in comparison with conventional or normal standard belts or fabrics which do not have any shock absorption properties.

Although it is already known that, in fabrics or belts which are commercially available at the present time, in addition to the particular construction which however has the disadvantage of increasing the thickness of the belt, a thermal treatment is also carried out. However, that thermal treatment is performed after the step of combining the materials, in the case of a fabric, after the weaving process, so that the properties of all materials used are altered in the same manner by the treatment carried out. It is not possible in that way to produce a particular curve configuration in the stress-stretch diagram, which is a disadvantage.

In order to provide a process for the production of a stretchable belt wherein an ideal stress-stretch curve can also be produced in a pre-programmable fashion, the invention provides that one or all materials which are used to form the belt are subjected to pretreatment mechanically and/or by means of heat during the combining operation. In that way the characteristics of the individual materials used for producing the belt can be individually adjusted and varied in such a way that finally, after the materials have been combined together, it is possible to give the ideal stress-stretch curve. In accordance with the invention, in that way, it is possible to produce a belt comprising a combination of the same or different base materials, which gives different stress-stretch curves.

In that connection, it is particularly desirable if, in accordance with the invention, the additional material and/or the base material with the higher degree of stretchability is or are set to a given reference stretch value by virtue of the material being drawn, shrunk and/or processed mechanically by twisting. In the case of the fabric, for example, the warp is disposed in the form of a stem portion in the centre of the belt, extending in a straight line throughout, and is enclosed by a double fabric. The double fabric, the upper and lower warp, are joined in this embodiment by a third joining warp. By virtue of that construction, after influencing the individual materials for the warp, it is possible for the composite structure to be subjected to optimum pre-programming in regard to stretch, without the stretchability or the energy absorption capability of the belt being increased by the construction itself and without the thickness having to be increased in comparison with the conventional standard belts. More specifically, for reasons of space and weight, the motor vehicle industry uses small automatic belt retraction units and belt systems, which require the use of thin belts.

The treatment carried out in accordance with the invention on the individual materials before or at latest during the operation of combining them together, for example in the weaving process, comprises for example in the thermal treatment, drawing or shrinking the material in the hot condition and then cooling it down for fixing it. Without heat, the materials can also be subjected to a mechanical pretreatment by twining or twisting the threads or yarns.

The production process is particularly desirable, in accordance with the invention, when the following formula is applied:

$$BD^{(II+I)}=MD^{(II+I)}+KD^{(II+I)}+VD/S$$

wherein:

BD = reference stretch
MD = material stretch (1)
KD = construction stretch (2)
VD/S = stretch or extension to be preset (3)
I = phase I
II = phase II The foregoing formula means that the given reference stretch in the course of phases II and I, when stretching a belt, to produce the above-described stress-stretch curve, can be calculated by addition of the following three summands: The first command represents material stretch in stretch phases II and I. The second summand represents construction stretch and the third summand is the stretch or extension which is preset or which is to be preset.

The material stretch is that stretchability which is already present in the material, both in the base material and in the additional material. Construction stretch means the stretchability which can be or is achieved by the construction of the belt structure. It has already been indicated above that it is not possible to achieve a particular margin of allowance for the modern production process in this respect, if the belt is not to be allowed to become too thick. The most interesting summand is therefore the third, the stretch or extension which is to be preset in the belt; that is to say, the stretchability which is imparted or which is to be imparted to the respective material by a mechanical or thermal pretreatment. Drawing, shrinking, twisting are some of the possible ways of influencing the materials.

Therefore, the formula will be mathematically resolved in accordance with the last summand, thus giving the following relationship:

$$VD/S = BD^{(I+II)} - [(MD^{II} + KD^{II}) + (MD^{I} + KD^{I})]$$

In that connection, it is particularly advantageous in accordance with the invention for the thermal and/or mechanical treatment of the material of a fabric to be effected prior to the weaving process, while that in respect of a material of a laminated structure is advantageously effected before the laminating operation. The respective material can best be treated in those steps in the processes.

Further advantages, features and possible uses of the present invention will be apparent from the following description of preferred embodiments with reference to the accompanying drawing in which.

Figure 1:
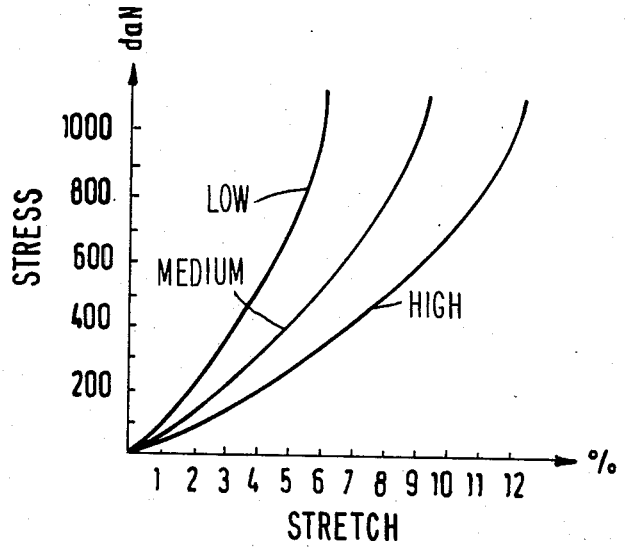
FIG. 1 shows a stress-stretch diagram as can be achieved with conventional belts.

If in the diagrams shown in the drawing, the force is plotted in daN versus stretch in percent, conventional belts, by virtue of a given construction and possibly an additional thermal treatment, give a curve configuration which rises steadily from the zero point. Depending on the treatment, it is possible to produce fabrics or belts of high stretch, medium stretch or low stretch.

That known load characteristic is not ideal.

Figure 2:
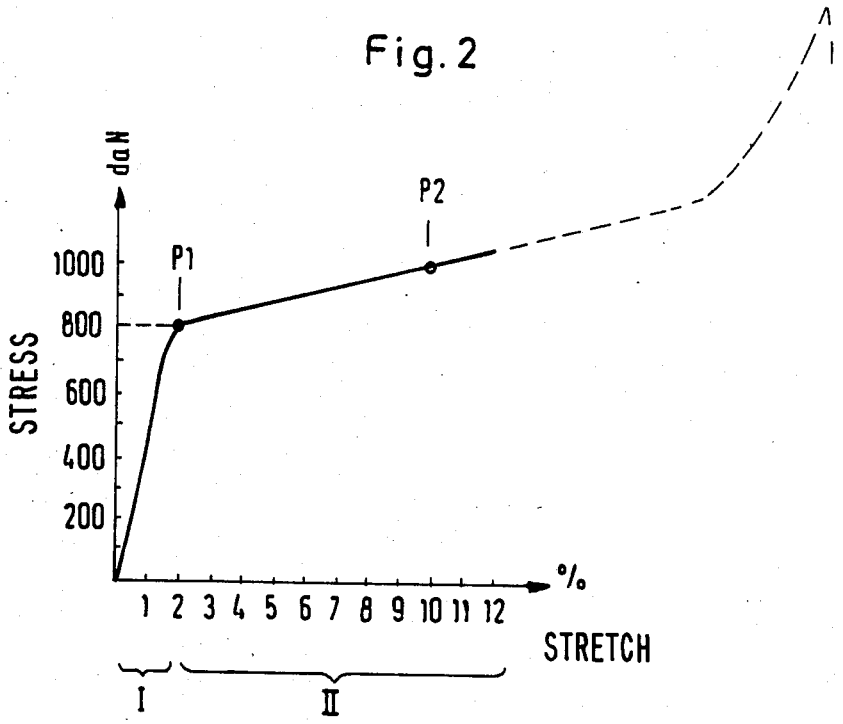
FIG. 2 shows a stress-stretch diagram in the case of a belt according to the invention.

By virtue of a combination of the same and/or different base materials which have different stretch curves of the kind shown in FIG. 1, upon use thereof in a single-ply or multi-ply fabric, it is possible to produce curves as shown for example in FIG. 2. That arrangement involves a belt which is formed in accordance with the invention and wherein the yarns or threads with a low stretch performance or a low degree of stretch are used as the carrier threads or yarns. They may also be referred to as tear yarns or threads. Those yarns or threads tear abruptly at point P1 in FIG. 2, being the first loading point. At that point, the load applied to the belt is transferred in the above-described manner to the other carrier threads or yarns which have a higher stretch capability. In a particularly advantageous belt, the curve shown in FIG. 2 is produced in that way. The curve illustrated in FIG. 2 begins at the zero point and, with increasing force, without substantial stretch, rises steeply to point P1. This involves a rapid build-up in loading, in which for example a degree of stretch of 2% is attained, with a force of 800 daN. After the point P1, the curve then flattens off and reaches a degree of stretch of 10%, for example at 1000 daN. If the belt is then further loaded, the curve initially continues until the stretch capability of the carrier or base material is also exhausted. Then, as shown in broken line in the right-hand part in FIG. 2, the curve will become steeper until reaching an end point at which those yarns or threads also tear. After that, the stress-stretch curve dips sharply downwardly.

Figure 3:
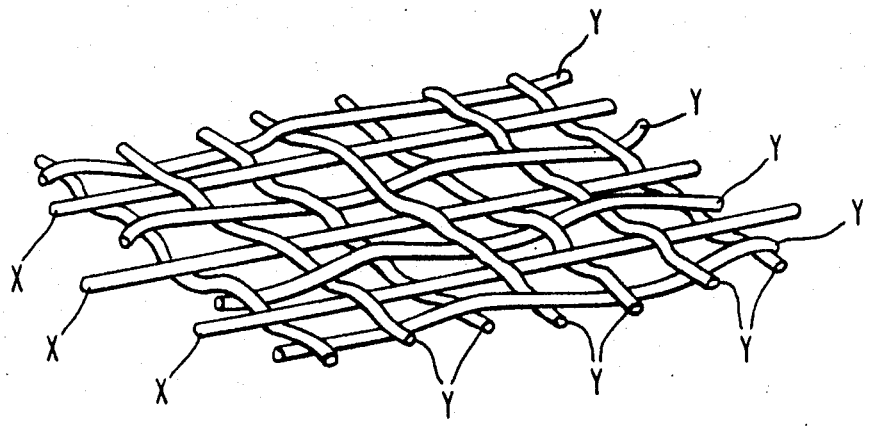
FIG. 3 shows a portion of a belt in accordance with the invention.

Although the broken-line region is important from the point of view of the functions of a safety belt, the initial values are crucial from the point of view of suitable body loading. In that part of the curve, the curve is subdivided into phase I between the zero point and point P1 and phase II between points P1 and P2. The initial curve pattern (phase I) of the diagram shown in FIG. 2 is determined, when the belt is subjected to a longitudinal loading, by the use of the low-stretch additional material which, in the case of a woven fabric, as shown in FIG. 3 is the warp material (X) which is embedded in the more severely deformable base material (Y). The material (X) which is crucial in regard to phase I has no or almost no material or construction stretch. When the belt is further loaded beyond point P1, then tearing of the additional material (X) is found substantially in the region of the point P1 and the further course of the curve (phase II) is determined by the base or carrier material (Y) which is a higher-stretch material or has a higher degree of stretchability. That material has been subjected to a thermal and/or mechanical pre-treatment, a stretching process by shrinking or an extension process by drawing or drafting. In that way, that material could be brought to a predetermined degree of reference stretch. In the example shown in FIG. 2, the given point P2 at which that reference stretch is preset or measured, occurs at 10%/1000 daN. That point is therefore referred to as reference stretch because reference is made to a given loading.

By virtue of the features in accordance with the invention, it is advantageously possible to pre-program the further course of the curve (phase II) between the points P1 and P2.

The configuration of the curve from the zero point to a given reference stretch at point P2 is defined by:

Material stretch (1)+construction stretch (2)+stretch or elongation imparted by pretreatment (3).

It has already been stated that material stretch or stretchability is already present in the material. The extension or stretch (3) is produced by suitable pretreatment. Depending on the mass of the low-stretch additional material (X), it is possible for the initial curve configuration from the zero point to point P1 (phase I) to be defined in a precisely pre-programmed manner, by performing the pretreatment according to the invention. The same also applies in regard to phase II. The required different degrees of reference stretch in phases I and II cannot however be achieved by thermal or mechanical post-treatment of the belt when it has already been combined together or woven or constructed. Therefore, the mechanical or thermal treatment in accordance with the invention is called the pre-treatment which must be carried out at latest during the weaving process or the laminating process or the extrusion operation. In that connection, the foregoing consideration that the reference stretch is made up of the three summands mentioned can be used.

FIRST EXAMPLE

For the construction of a woven fabric or a belt or fabric which is constructed in some other fashion, a reference stretch of for example 2% at 800 daN is required in a first phase (I); in a second phase (II), a reference stretch of 10% at 1000 daN is required, the following formula being applied:

$$BD^{(II+I)}=MD^{(II+I)}+KD^{(II+I)}+VD/S \quad (A)$$

or $$VD/S=BD^{(I+II)}-[(MD^{II}+KD^{II})+(MD^{I}+KD^{I})] \quad (B)$$

wherein:

BD=reference stretch
MD=material stretch (1)
KD=construction stretch (2)
VD/S=stretch or extension to be provided (3)
I=phase I
II=phase II.

If numbers are then put in, that can be calculated as follows:

For a required reference stretch in accordance with phase II of 10%/1000 daN and a reference stretch of 2% at 800 daN in phase I, the calculations are as follows:

| | | | |
|---|---|---|---|
| reference stretch in accordance with phase I + II | | | 10% |
| material stretch in phase II | 4.25% | | |
| construction stretch in phase II | 1.75% | | |
| total stretch in phase II | | 6% | |
| material stretch in phase I | 1.75% | | |
| construction stretch in phase I | 0.25% | | |
| total stretch in phase I | | 2% | |
| total stretch in phases I + II | | | 8% |
| stretch to be provided in the material (3) | | | 2% |

or in figures:
in accordance with (A):
10%=(4.25+1.75)%+(1.75+0.25)%+2%
in accordance with (B):
+2%=(2+8)%−[(4.25+1.75)+(1.75+0.25)]%.

EXAMPLE 2

For a required reference stretch in accordance with phase II of 6%/1000 daN, or at 2%/800 daN in accordance with phase I, the calculation is to be as follows:

| | | | |
|---|---|---|---|
| reference stretch in accordance with phase I + II | | | 6% |
| material stretch in phase II | 4.25% | | |
| construction stretch in phase II | 1.75% | | |
| | | 6% | |
| material stretch in phase I | 1.75% | | |
| construction stretch in phase I | 0.25% | | |
| | | 2% | |
| | | | 8% |
| stretch to be provided in the material (3) | | | −2% |

or in figures:
in accordance with (A):
6%=(4.25+1.75)%+(1.75+0.25)%−2%
in accordance with (B):
−2%=(2+4)%−[(4.25+1.75)+(1.75+0.25)]%.

With the above-described means, it is possible to preprogram a stress-stretch characteristic and to provide a thin belt which is of the same thickness as conventional standard belts without the energy absorption performance. In other words, it is possible to provide a thin belt with a high potential of energy absorption. In the case of an abrupt or shock loading, such a belt transmits a lower degree of load to the fixing points of the belt system, than is the case with conventional belts with the same reference stretch.

Therefore, a lower loading is likewise also transmitted to the occupants of the vehicle or the object to be secured, which is an advantage.

When using the belt or fabric according to the invention, in particular in safety belt systems, accessory devices such as for example belt clamps or belt stiffeners which are usually used with vehicle safety belts in order to ensure a rapid initial rise in force can become completely or partly redundant. Because of the low degree of stretch which is to be found in the initial region of the curve (phase I) in FIG. 2 with the belt according to the invention, that gives approximately the same effect as when using belt clamps or stiffeners. As with the additional belt clamping means or belt stiffeners, when using conventional belts, the energy which is liberated upon loading of the object to be secured can be more rapidly transmitted to the safety belt system when using the belt according to the invention, without the above-mentioned accessory devices.

Figure 4:
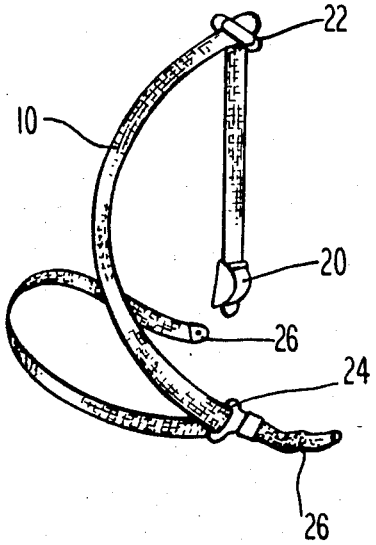
FIG. 4 shows a belt according to the present invention for restraining an occupant of a motor vehicle at the time of an accident.

FIG. 4 shows a motor vehicle safety belt 10 according to the present invention. The belt 10 extends between a conventional seat belt retraction unit 20, through anchor bracket 22 and buckle 24 to anchor 26. The buckle 24 releasably engages anchor member 26 in a conventional manner.

I claim:

1. A stretchable belt, in particular a safety belt for restraint systems in vehicles, comprising a base material and at least one additional material which is combined therewith, characterised in that the base material is more highly deformable, with the same force, than the at least one additional material, in that the additional material has no or almost no material stretchability, and in that the additional material has no or almost no construction stretchability, said additional material being adapted to carry the load applied to said belt from a zero to a first loading point, said base material being adapted to carry the load from said first loading point to a second loading point.

2. A belt according to claim 1 characterised in that the base material and the additional material comprise the same raw material, differences in deformability of said materials being due to differences in treatment of said raw material.

3. A belt according to claim 1 characterised in that only two materials of different stretchability are combined together.

4. A belt according to claim 1 characterised in that the base material and the additional material are combined together by weaving to form at least single-layer fabric.

5. A belt according to claim 4 characterised in that said fabric comprises a warp and a carrier, said warp comprising said additional material and said carrier comprising said base material, said additional material carrying the load applied to said fabric from zero to a first loading point, and said base material carrying load from said first loading point to a second loading point.

6. A belt according to claim 5, wherein said belt stretches about 2% at a first loading point of about 800 daN, and stretches about 10% at a second loading point of about 1000 daN.

7. A belt according to claim 5, wherein said additional material tears abruptly at said first loading point, whereby said base material carries loads higher than at said first loading point.

8. A process for production of a stretchable belt, said belt comprising a base material and at least one additional material, said base material having higher deformability than said at least one additional material, comprising the steps of: a treatment step including treating at least one of said materials to alter its deformability characteristics; and a combining step including combining said materials to form a belt, wherein said treatment step is performed no later than during said combining step, said additional material being adapted to carry the load applied to said belt from a zero to a first loading point, said base material being adapted to carry the load from said first loading point to a second loading point.

9. A method of producing a stretchable belt from a base material and at least one additional material, said belt having a different stretch versus stress characteristic in a first phase (phase I), between the zero point and a first loading point P1, than in a second phase (phase II), between P1 and a second loading point P2, comprising the steps of:

determining a component of desired stretch VD/S to provide a reference stretch $BD^{(I\ \&\ II)}$ at P2 according to the formula $$VD/S = BD^{(I\ \&\ II)} - ((MD^{II} + KD^{II}) + (MD^{I} + KD^{I})),$$

where $MD^{I}$, $MD^{II}$ = stretch already present in the materials in phases I and II, respectively, and $KD^{I}$, $KD^{II}$ = stretch due to the belt structure in phases I and II, respectively;

treating at least one material to provide said component of desired stretch VD/S; and combining said base material and said additional material to form a belt.

10. A process according to claim 8 or claim 9 wherein said treating step comprises mechanical treatment or thermal treatment.

11. A process according to claim 8 or claim 9 wherein said combining step consists of weaving or laminating.

* * * * *